US007750870B2

(12) United States Patent
Bezal et al.

(10) Patent No.: US 7,750,870 B2
(45) Date of Patent: Jul. 6, 2010

(54) PLASMA DISPLAY PANEL CONTROL CIRCUIT

(75) Inventors: Jean-Raphael Bezal, Meylan (FR); Gilles Troussel, Grenoble (FR); Jean-Marie Permezel, Grenoble (FR)

(73) Assignee: STMicroelectronics SA, Montrouge (FR)

( * ) Notice: Subject to any disclaimer, the term of this patent is extended or adjusted under 35 U.S.C. 154(b) by 1133 days.

(21) Appl. No.: 11/367,672

(22) Filed: Mar. 3, 2006

(65) Prior Publication Data

US 2006/0196855 A1 Sep. 7, 2006

(30) Foreign Application Priority Data

Mar. 3, 2005 (FR) ..... 05 50574

(51) Int. Cl.
*G09G 3/28* (2006.01)

(52) U.S. Cl. ..... 345/60; 345/61; 345/62; 345/67; 345/68; 345/204

(58) Field of Classification Search ..... 345/60–62, 345/67–68, 204
See application file for complete search history.

(56) References Cited

U.S. PATENT DOCUMENTS

| | | | | |
|---|---|---|---|---|
| 5,654,728 | A * | 8/1997 | Kanazawa et al. | 345/68 |
| 2002/0190928 | A1 | 12/2002 | Iwami et al. | 345/60 |
| 2003/0214462 | A1 | 11/2003 | Roh et al. | 345/60 |

* cited by examiner

*Primary Examiner*—Richard Hjerpe
*Assistant Examiner*—Leonid Shapiro
(74) *Attorney, Agent, or Firm*—Lisa K. Jorgenson; E. Russell Tarleton; Seed IP Law Group PLLC

(57) ABSTRACT

A method and circuit to control of a circuit for addressing at least one line electrode of a plasma display panel having, for each line, a line selection stage formed of two switches in series between two input terminals of the selection stage, the method including use of a first one of the two switches of the selection stage of each line to flow a current from or to an inductive element of the addressing circuit.

18 Claims, 5 Drawing Sheets

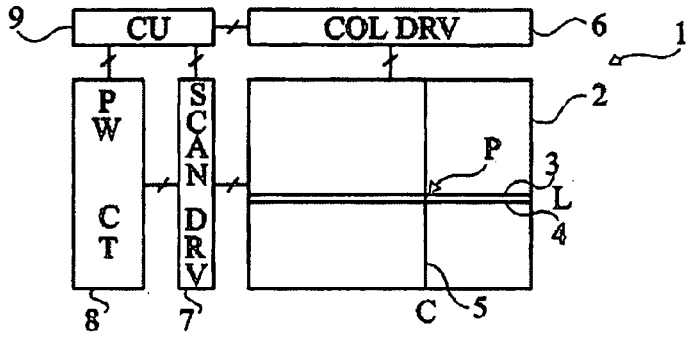
FIG. 1
(Prior Art)
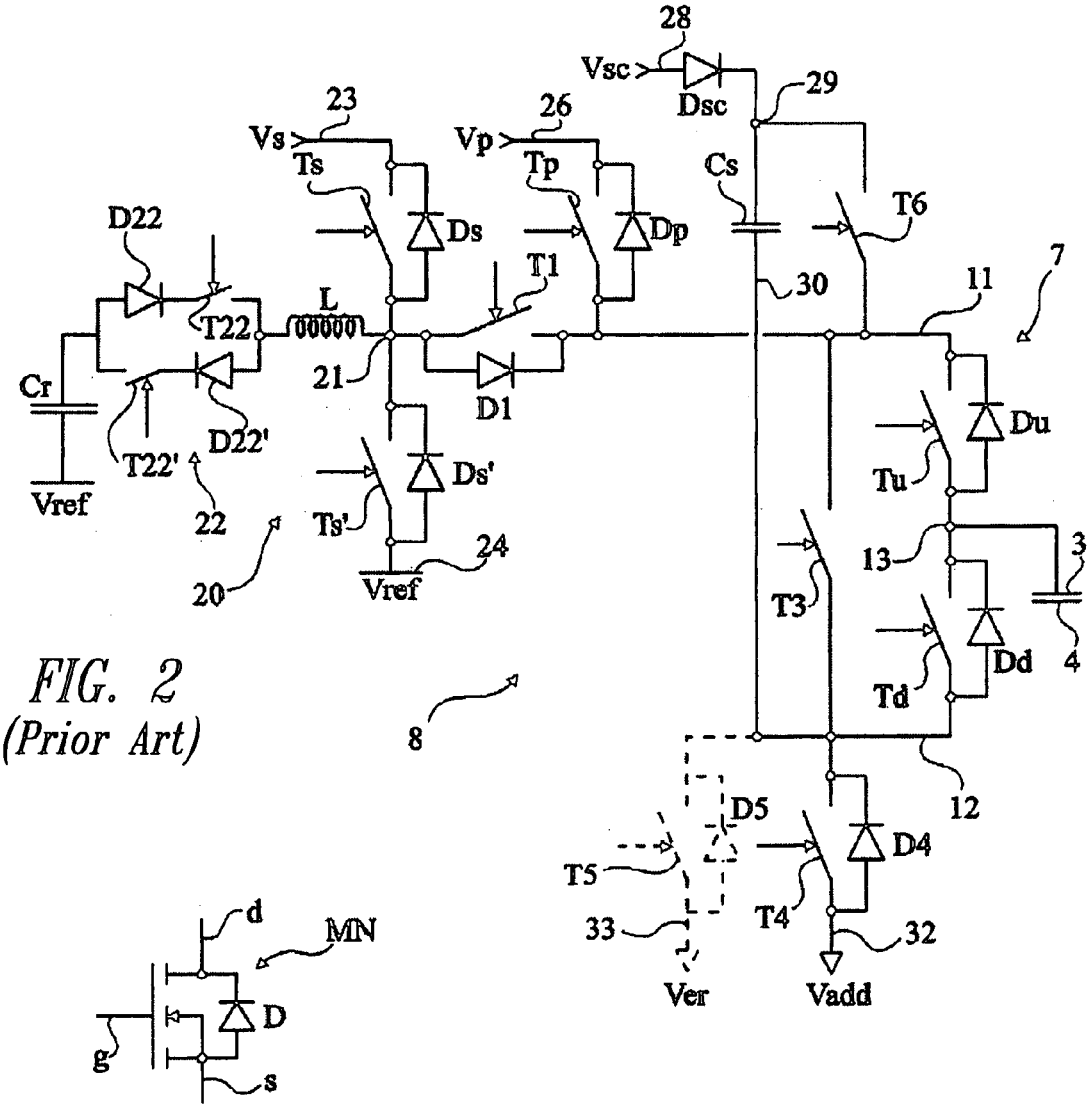
FIG. 2
(Prior Art)
FIG. 3
(Prior Art)

PLASMA DISPLAY PANEL CONTROL CIRCUIT

BACKGROUND OF THE INVENTION

1. Field of the Invention

The present invention generally relates to memory-effect plasma display panels generally having two parallel plates, each supporting electrode networks and between which is present a gas causing luminous discharges at regions of intersection between the electrodes of the plates and, more specifically, to a circuit for controlling one of the electrode networks of the panels, used both to address pixels and to maintain an excitation of the pixels.

2. Description of the Related Art

FIG. 1 generally and very schematically shows the structure of a plasma display panel 1 (PDP) of the type to which the present invention applies. Two parallel plates designated by general reference 2 each support electrodes generally perpendicular from one plate to the other and parallel to each other on a same plate. Each line L of the display panel is defined by two parallel electrodes 3 and 4 and each column C of the display panel is defined by an electrode 5 in the other direction supported by the other plate. The intersection of a line L and of a column C defines a pixel P of the screen. To light a pixel, a luminous discharge is organized between electrodes 3 and 4 of a line L, addressed by the corresponding column 5.

The control of screen 2 is performed by means of column electrode control circuits 6 (COL DRV) and line electrode control circuits 7 (SCAN DRV), the latter being connected to power supply circuits 8 (PW CT). Circuits 6, 7, and 8 are controlled and synchronized by a unit 9 (CU), generally a microcontroller or a circuit in wired logic.

The present invention more specifically relates to the control of electrodes 3 and 4 of lines of a plasma display panel.

FIG. 2 schematically shows an example of a conventional circuit for controlling electrodes 3 and 4 of a line of a screen 2 such as shown in FIG. 1. The circuits shown in FIG. 2 are, in FIG. 1, contained in blocks 7 and 8. The circuit of FIG. 2 is based on the use of switches operating in all or nothing, i.e., either on or off, to bring, onto one of the electrodes (for example, electrode 3) of the considered line, different voltage levels at different operating phases. For simplification, the control signals generated by unit 9 have not been detailed. Further, the different switches have been schematically shown, most often in parallel with a reverse voltage hold diode.

In practice and as illustrated in FIG. 3, which shows an example of a switch used in the circuit of FIG. 2, each switch is formed of an N-channel MOS transistor MN having its intrinsic diode D connecting the source s to the drain d, forming the diode of the involved switch. Gate g of MOS transistor MN forms the switch control electrode. The switches may also be insulated-gate transistors (IGBT) or others.

The control circuit of each electrode 3, contained in block 7 (scan driver) of FIG. 1, is formed of two switches Tu and Td in series between two terminals 11 and 12 and having their junction point 13 directly connected to electrode 3 (conductive line of screen 2). The other electrode 4 parallel to electrode 3 and belonging to the same line is generally connected to a circuit (not shown) of provision of a reference voltage. Each switch Tu, Td is in parallel with a diode Du, Dd respectively, the respective anodes of diodes Du and Dd being connected to terminals 13 and 12. Switches Tu and Td are used to select that electrode 3 of the display panel lines that will receive the different voltages to be applied thereto. For simplification, a single circuit 7 has been shown in FIG. 2. In practice, all the circuits 7 (as a variation, groups of circuit 7) of screen 2 have their respective terminals 11 and 12 interconnected to a common power supply circuit 8.

The supply circuit 8 includes a so-called Weber-type energy recovery stage 20 intended to impose a voltage on the line electrode 3 by carrying off excess charges or by bringing missing charges on electrode 3 in a so-called sustain operating phase. The recovery stage 20 mainly includes an inductive element L connecting, by a bidirectional switch 22, an electrode of a capacitor Cr to an output terminal 21 of the stage, connectable to electrode 3. The switch 22 is typically formed of two switches T22 and T22' in antiparallel and each in series with a diode D22, respectively D22'. The output terminal 21 of the recovery stage 20 is connected, by a switch Ts, to a terminal 23 of application of a positive voltage Vs and, by a switch Ts', to a terminal 24 of application of a reference voltage Vref (typically, the ground). Each switch Ts and Ts' is in parallel with a diode Ds, respectively Ds', the respective anodes of diodes Ds and Ds' being connected to the output and ground terminals 21 and 24, respectively.

The output terminal 21 of the recovery circuit 20, and thus inductance L providing or absorbing a current, is connectable to the input terminals 11 of all scan driver circuits 7 by a same switch T1 in parallel with a diode D1 having its anode connected to node 21.

A stage of prebiasing or precharge of electrodes 3 is formed of a switch Tp connecting a terminal 26 of application of a positive voltage Vp (greater than voltage Vs) to the input terminal 11, with switch Tp being in parallel with a diode Dp having its anode connected to input terminal 11 (across all circuits 7).

An addressing step is formed of a capacitor Cs charged, via a diode Dsc, with an addressing voltage Vsc applied on a terminal 28, the anode of diode Dsc being connected to terminal 28 and its cathode being directly connected to a first electrode 29 of capacitor Cs. A switch T6 connects electrode 29 to input terminals 11 and second electrode 30 of capacitor Cs is connected directly to input terminals 12 of the scan driver circuits 7. For simplification, the parasitic diode of the MOS transistor forming switch T6 has not been shown, since said diode is not used in this assembly.

An addressing reference voltage Vadd is generally applied to input terminals 12 by means of a switch T4 connecting terminals 12 to a terminal 32 of application of voltage Vadd (negative with respect to ground), a diode D4 being in parallel with switch T4, its anode being connected to terminal 32.

In certain cases, an erasing voltage Ver, different from reference addressing voltage Vadd, is applied by an erasing stage (in dotted lines in FIG. 2) formed of a switch T5 in parallel with a diode D5 connecting terminals 12 to a terminal 33 of application of voltage Ver, intermediary between voltage Vadd and reference voltage Vref, the anode of diode D5 being connected to terminal 33 of application of voltage Ver.

Finally, a switch T3 interconnects all the terminals 11 and 12, no diode has been shown in parallel with this switch since, even if it is present with the MOS transistor forming the switch, it is not used herein.

A control circuit such as illustrated in FIG. 2 is described, for example, in international patent application WO 03/102907.

FIGS. 4 and 5 shows an example of timing diagrams illustrating the operation of the circuit of FIG. 2. They respectively show timing diagrams of voltage V3 present on an electrode 3 of a line during a display sub-frame, and the respective off or on states of the different switches. In FIG. 5, an indifferent state of a switch has been illustrated by a cross during the considered period. In the representation of FIGS. 4 and 5, the presence of an erasing voltage Ver different from addressing voltage Vadd is assumed. If the two voltages are confounded, the controls of switches T4 and T5 are accordingly adapted.

Electrode 3 is initially assumed to be at voltage Vs.

In a so-called prebiasing or precharge phase I (from a time t1), switch T1 is off, as well as switches T4, T5, T6. Switches T3 and Tp are on so that voltage Vp is applied to electrode 3 by diode Dd. During this phase I, switch Tu is off and switch Td is on. Switches Ts and Ts' are either both off, or in inverted states with respect to each other. The same occurs for switches T22 and T22'. The function of the prebiasing phase is to excite the cells to pre-excite the gas contained in the screen to lower the addressing voltage under which the discharge will be performed afterwards. Typically, voltage Vp is on the order of 400 volts.

At the end (time t2) of the prebiasing phase, a so-called stabilization phase II starts. During phase II, switch Tp is off and will remain so until the beginning of a next sub-frame (time t1'). Switches T4, T5, and T6 remain open. Switch T1 is on. This phase aims at bringing the voltage of input terminal 11 to level Vs. Accordingly, switch Ts is on while switch Ts' is off. Switch T3 for example remains on, but its state is of no importance during this phase. The states of switches Tu and Td are indifferent, as well as the states of switches T22 and T22'.

At the end (time t3) of stabilization phase II, a so-called erasing phase III aiming at bringing electrode 3 to point Ver starts. In the shown example, erasing level Ver is assumed to be lower than level Vref (ground). In other cases, this erasing voltage may be equal to ground. At time t3, switch T5 is on. Switch T1 is off to isolate recovery stage 20 from the rest of the circuit, and switches T4 and T6 remain off. Switches T3 and Tu are off and switch Td is on. The discharge of the voltage of electrode 3 down to level Ver is performed by means of switch Td.

Phases II and III of erasing of the prebiasing result in suppressing the charges to avoid undesired start-ups. The erasing ramp of phase III is obtained by a current generator series-connected with switch T5 (for example, by a resistor).

At an end time t4 of the erasing phase, a so-called addressing phase IV which aims at bringing an addressing voltage corresponding to level Vsc or to level Vadd on electrodes 3, according to the respective states of transistors Tu and Td of their addressing circuit 7, starts. During this phase, switch T1 is indifferently off or on and switches T4 and T6 are on to bring respective levels Vsc and Vadd onto terminals 11 and 12. Switch T3 is off to separate terminals 11 and 12. Switch T5 is off.

Period tIV in phase IV during which switch Tu is off and switch Td is on depends on the rank of the line in the line group or in the display panel.

At a time t5 corresponding to the end of the addressing phase, a so-called sustain phase V during which a pulse train of constant duty cycle and of amplitude Vs is applied on terminal 23 starts. During this phase, switch T1 is on to bring the pulses onto circuits 7, and switch T3 is also on, while switches T4, T5, and T6 are off to isolate the addressing and erasing stages. Switch Tu is off and switch Td is on. In sustain phase V, recovery stage 20 is used to ease the charge of electrodes 3 to level Vs and ease the discharge of the same electrodes in the respective low levels of the pulses. The turning on and off of switches Ts and Ts' alternate at the rate of the pulses of level Vs to be applied to terminal 11. Switches T22 and T22' are, for example, alternately turned off and on synchronously with the turning off and on of switches Ts and Ts'.

At the end (time t6) of the sustain phase, electrode line 3 is brought to erasing voltage Ver, in a so-called initialization phase VI carrying on until time t1' of beginning of the next sub-frame. In phase VI, switch T1 remains on while switches T4 and T6 remain off, switch T5 is on and switch T3 is off. Switches Ts, Ts', T22, and T22' are off. The discharge of electrode 3 is ensured by the turning-on of switch Td, the state of switch Tu being off.

A disadvantage of the circuit of FIG. 2 is linked to the significant current flowing through transistors T1 and T3 during phases II, V, and VI in which the recovery stage is used. This imposes using transistors T1 and T3 of large dimensions, and thus expensive.

BRIEF SUMMARY OF THE INVENTION

The disclosed embodiments of the present invention overcome all or part of the disadvantages of known plasma display panel control circuits.

In one embodiment, the present invention suppresses the switch (T3, FIG. 2) interconnecting the addressing circuit input terminals.

To achieve all or part of these features, as well as others, one embodiment of the present invention provides a circuit for addressing at least one line electrode of a plasma display panel including, for each line, a line selection stage formed of two switches in series between two input terminals of the selection stage, using a first one of the two switches of the selection stage of each line to flow a current from or to an inductive element of the addressing circuit.

According to another embodiment of the present invention, said first switch of the selection stage is used to apply at least one first positive voltage originating from a first voltage provision stage on said electrode.

According to a further embodiment of the present invention, an addressing frame includes a first phase of application of said first voltage, during which the first and second switches of each line selection stage are respectively on and off.

According to yet another embodiment of the present invention, the method includes a subsequent phase of application of a negative voltage, during which the first and second switches are respectively off and on.

In accordance with the present invention, a circuit is provided for controlling at least one electrode of a plasma display panel. The circuit includes one selection stage for each line, formed of two switches in series between two input terminals of the stage, the junction point being connected to the electrode to be controlled; and at least one circuit for supplying power to the selection stages, including a first stage of application of a first positive voltage to a first terminal of the selection stages, and a second stage comprising an inductive element for supplying a current on said first terminal in which a first switch of the selection stages is turned on at least for a phase of supply of said current to the electrode.

According to an embodiment of the present invention, the first switch is turned on for the application of the first voltage.

According to an embodiment of the present invention, said second stage provides a second positive voltage smaller than the first one, said first switch of the selection stages being turned on for at least a subsequent phase of application of the second voltage.

According to an embodiment of the present invention, said power supply circuit includes a first switch isolating the first and second stages from each other; and a capacitive element connectable between said terminals for the application of a third voltage, smaller than the second one.

According to an embodiment of the present invention, the power supply circuit comprises at least one third stage of application of a fourth negative voltage on the second terminal of the selection stages, said first switch of the selection stages being turned off for periods of supply of the fourth voltage. Ideally, the capacitive element directly connects the terminals of the selection stages, permanently, with the third voltage being a negative voltage applicable on the second terminal of the selection stages.

According to an embodiment of the present invention, no switch is provided in the circuit common to several selection stages to directly connect said input terminals of these stages.

In accordance with another embodiment of the present invention, a plasma display panel is provided along with a method of controlling the same. More particularly, a method for controlling current flow on an electrode of a display device is provided, the electrode coupled to a node formed by a series connection of a first switch and a second switch that in turn are coupled between a first input and a second input, respectively, with the first input coupled to a first voltage source and the second input coupled to a second voltage source. The method includes applying a precharge voltage to the electrode through the first switch without connecting the first and second inputs directly together.

In accordance with another aspect of the foregoing embodiment, after applying the precharge, a pulse train signal or voltage, preferably of constant duty cycle, is applied to the first node via the first switch. Preferably the pulse train is applied without connecting the first and second inputs directly together.

In accordance with another aspect of the foregoing embodiment, an erase voltage is applied to the electrode through the second switch, preferably after applying the pulse train.

In accordance with another embodiment of the invention, a circuit for controlling an electrode of a plasma display device is provided, the circuit including first and second switches series connected between first and second inputs, respectively, to form an output node at the connection between the first and second switches, and having no single switch directly connecting the first input terminal to the second input terminal; and a first voltage potential coupled to the first input, and a second voltage potential coupled to the second input.

In accordance with another aspect of the foregoing embodiment, a capacitor is coupled between the first input and the second input. More particularly, the capacitor has a first terminal coupled to the first input and the capacitor has a second terminal coupled to the second input.

In accordance with another aspect of the foregoing embodiment, the first voltage potential includes a scan voltage circuit directly coupled to the first input, and a precharge voltage circuit and a recovery circuit coupled to the first input line via a third switch.

In accordance with another aspect of the foregoing embodiment, a control circuit is provided that is configured to couple the first voltage potential to the electrode through the first switch without directly coupling the first and second input lines together. Ideally, the control circuit is also configured to couple the first voltage potential, including the scan voltage circuit to the first line and to couple a precharge voltage and a recovery circuit to the first line via a third switch. In addition, the control circuit is configured to couple an erase voltage circuit to the electrode through the second switch.

BRIEF DESCRIPTION OF THE SEVERAL VIEWS OF THE DRAWINGS

The foregoing and other objects, features, and advantages of the present invention will be discussed in detail in the following non-limiting description of specific embodiments in connection with the accompanying drawings.

FIG. 1, previously described, very schematically shows an example of a plasma display panel architecture to which the present invention applies;

FIG. 2, previously described, shows an example of a conventional circuit for controlling electrodes of a plasma display panel;

FIG. 3, previously described, shows a conventional example of a switch in parallel with a diode of the circuit of FIG. 2;

DETAILED DESCRIPTION OF THE INVENTION

Figure 4:
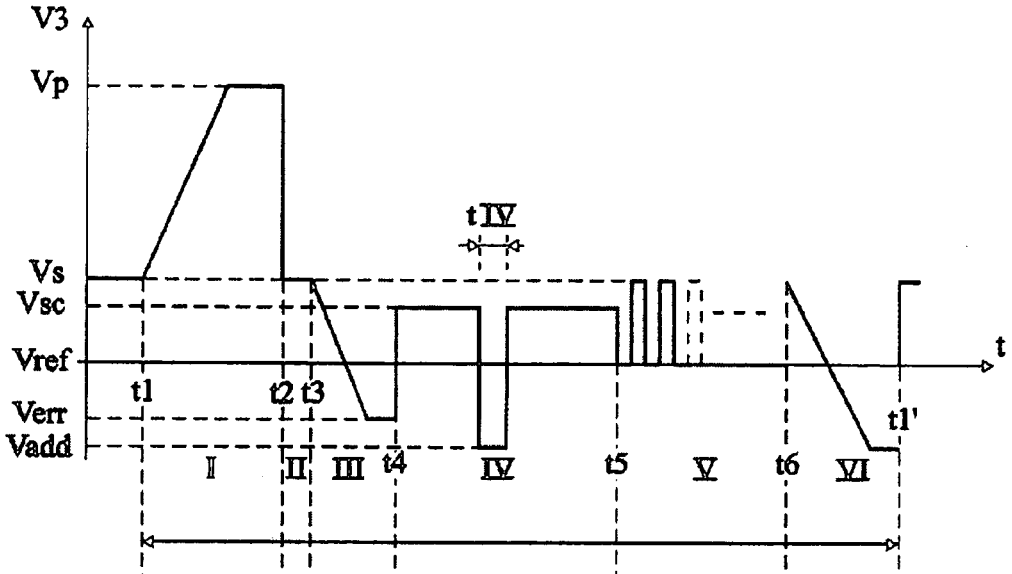
FIG. 4 (Prior Art)
FIG. 4, previously described, is a timing diagram illustrating the operation of the conventional circuit of FIG. 2 in a display sub-frame.

The same elements have been designated with the same reference numerals in the different drawings and the timing diagrams of FIGS. 4, 5, 7, 8 have been drawn out of scale. For clarity, only those elements and operation steps which are useful to the understanding of the present invention have been shown in the drawings and will be described hereafter. In particular, the generation of the control signals adapted to the operation of the switches has not been detailed, the present invention being compatible with the use of conventional circuits for generating such signals. Similarly, the general operation of a plasma display panel (especially, the control of the other display panel electrodes) has not been detailed, the present invention being compatible with conventional systems.

Figure 6:
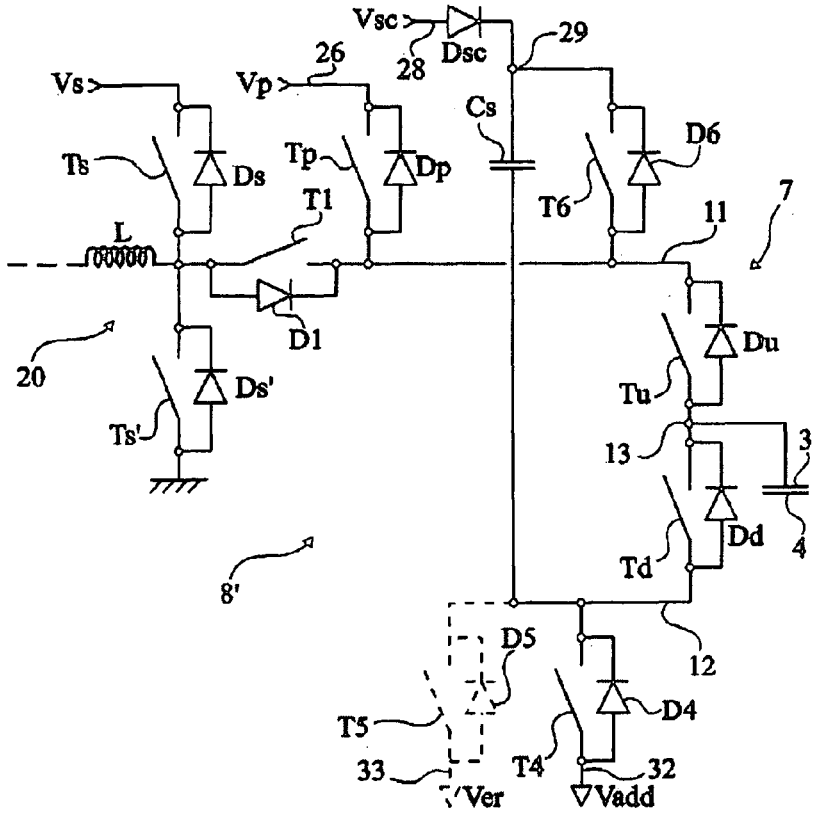
FIG. 6 shows a circuit for controlling electrodes of a plasma display panel according to a first embodiment of the present invention.

FIG. 6 shows a circuit for controlling a conductive line 3 forming an electrode of a plasma display panel according to an embodiment of the present invention. As previously, each conductive line 3 is connected to output node 13 of a stage 7 for selecting a line which shares two input terminals 11 and 12 with all the other display panel stages 7 (or in groups). Terminals 11 and 12 are connected to a power supply circuit 8' which, as previously described, includes:

a stage 20 of energy recovery (shown only partially from inductance L) and of application of a voltage Vs, a switch T1 in parallel with a diode D1 used to isolate the recovery stage from the rest of the assembly;

a stage of application of a prebiasing voltage Vp from a terminal 26, connected by a switch Tp in parallel with a diode Dp to terminal 11;

an optional erasing stage (shown in dotted lines), formed of a transistor T5 in parallel with a diode D5 between terminal 12 and a terminal 33 of application of an erasing voltage Ver;

a stage of application of a reference addressing voltage Vadd on terminal 12, formed of a switch T4 in parallel with a diode D4 between terminal 12 and a terminal 32 of application of voltage Vadd (where the stage of application of the addressing voltage may be confounded with that of application of the erasing voltage in the case where the two voltages are equal);

a stage of application of a scan voltage Vsc via a diode Dsc connecting a terminal 28 of application of voltage Vsc to a terminal 29 of a switch T6 having its other terminal connected to terminal 11, switch T6 being in parallel with a diode D6; and a capacitor Cs connecting terminals 29 and 12 for easing the charges and discharges of electrode 3.

Unlike the assembly of FIG. 2, no single switch (T3, FIG. 2) directly connects terminals 11 and 12.

A feature of this embodiment is to use transistor Tu of stage 7 of each line to flow the current coming from inductive element L of stage 20.

Another feature of this embodiment is to use transistor Tu of stage 7 of each line 3 to perform the isolation function previously fulfilled by transistor T3.

Each stage 7 is of conventional structure and is thus formed of two switches Tu and Td in series between terminals 11 and 12, each switch being in parallel with a diode Du and Dd and their junction point forming output terminal 13 of the stage.

Figure 7:
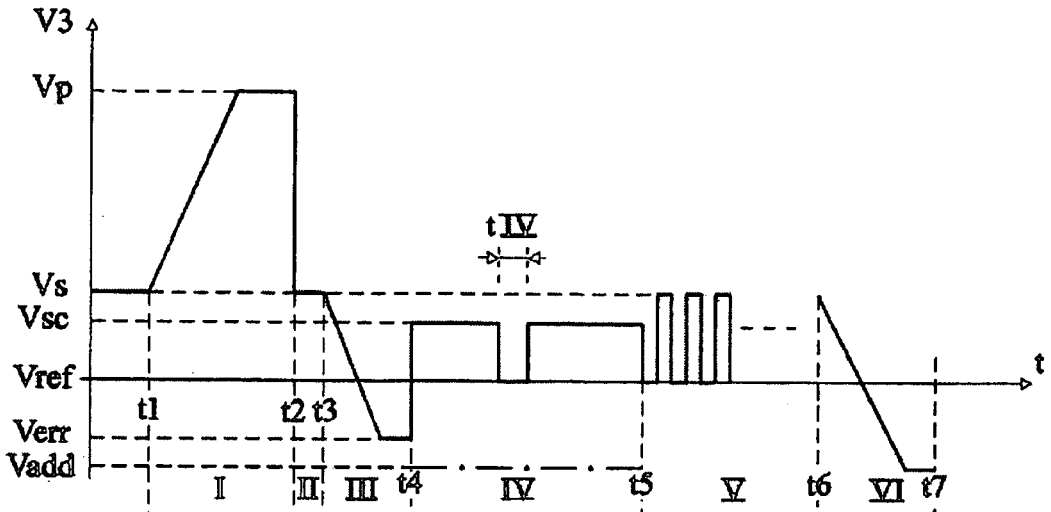
FIG. 7 is a timing diagram illustrating the operation of the circuit of FIG. 6 in a display sub-frame.
Figure 8:
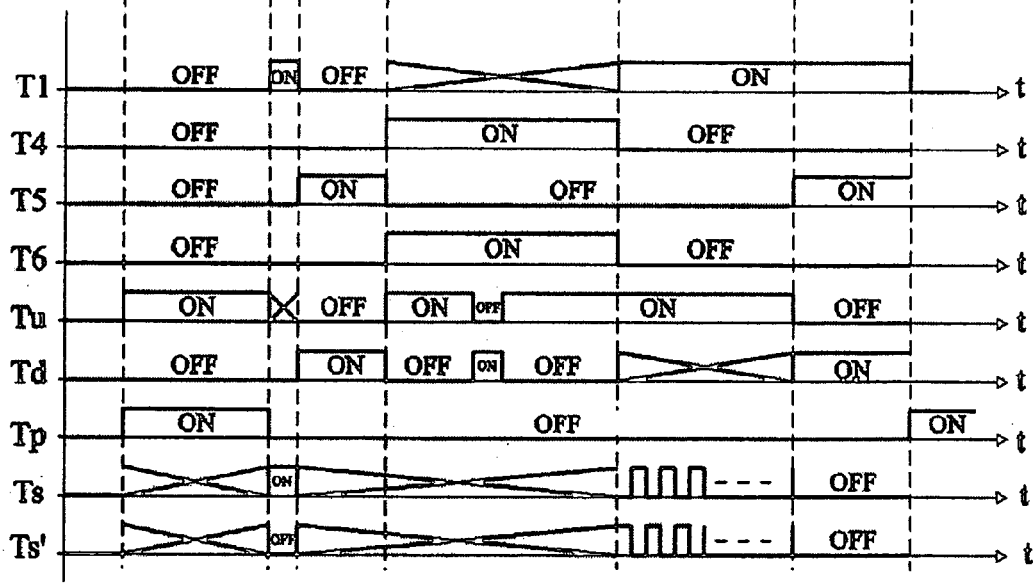
FIG. 8 shows, in the form of timing diagrams, the respective states of the switches of the circuit of FIG. 6 in the example of operation of FIG. 7.

FIGS. 7 and 8 illustrate, in timing diagrams, the operation of the circuit of FIG. 6. FIG. 7 shows a timing diagram of voltage V3 for a display sub-frame. This drawing is identical to previously-described FIG. 4. FIG. 8 shows the respective off and on periods of switches T1, T4, T5, T6, Tu, Td, Tp, Ts, and Ts' for this display sub-frame.

A first prebiasing or precharge phase I (times t1 to t2) must, as previously, support the voltage of electrode 3 at level Vp. For this purpose, switches T1, T4, T5, T6, and Td are off and switch Tp is on to bring voltage Vp onto terminal 11. According to this embodiment of the present invention, the switches Tu of all the stages 7 are on to enable prebiasing of their electrode 3. Switches Ts and Ts' (and switches T22 and T22', not shown) are either both off or in inverted states with respect to each other.

Between times t2 and t3 (phase II), the voltage of electrode 3 is brought to level Vs. Switches T1 and Ts are on while switches T4, T5, T6, and Td remain off. Switch Ts' is also off and the state of switch Tu is indifferent, since the discharge of electrode 3 to a voltage Vs can be ensured by diode Du.

From time t3, erasing phase III, which aims at bringing the voltage of electrode V3 to voltage Ver (as a variation, to voltage Vadd), starts. Switch T1 is indifferently off or on. Switch T5 is turned on to bring erasing voltage Ver and switch Td is on to enable discharge of electrode 3 to level Ver. At least one of the switches from among switch T6 and Tu is off. In the example, they are both off.

In the next addressing phase IV (between times t4 and t5), switches T4 and T6 are on while switch T5 is off. The state of switch T1 is indifferent. Switches Tu and Td are respectively off and on for a period tIV depending on the line rank in the line group or in the display panel.

In the next sustain phase V (between times t5 and t6), a pulse train is applied to terminal 23. Switch T1 is turned on and switches T4, T5, and T6 are off. Switch Tu is on and the state of switch Td is indifferent. The respective states of switches Ts and Ts' are alternated and switches T22 and T22' are, for example alternately turned off and on (synchronously or not with the turning on and off of switches Ts and Ts').

Figure 5:
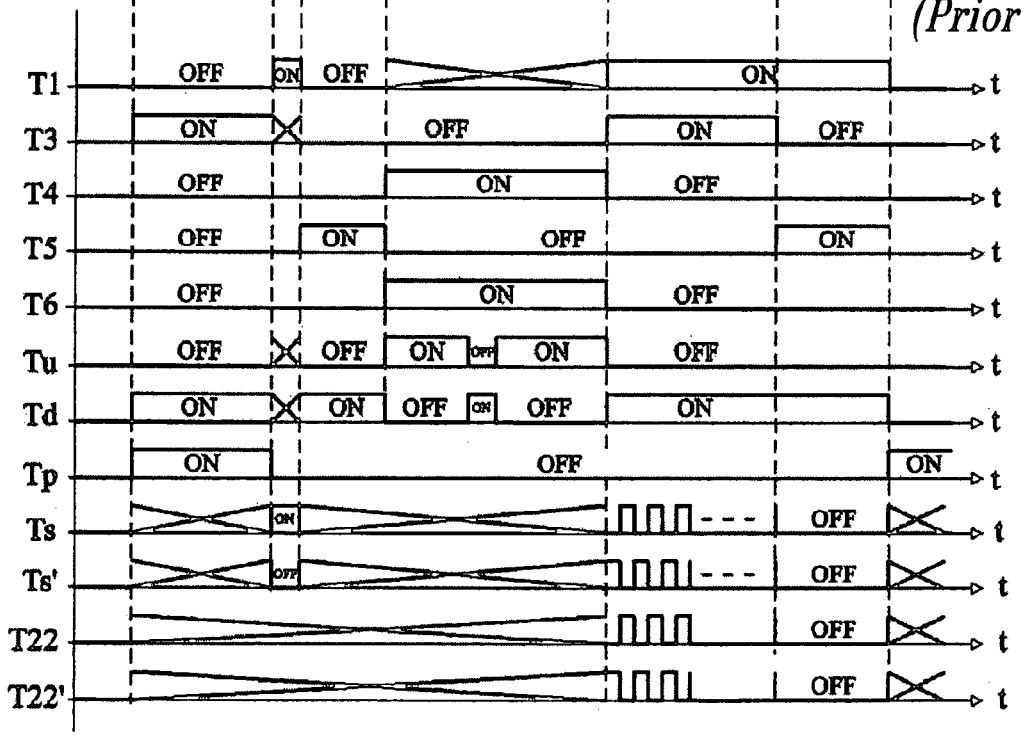
FIG. 5 (Prior Art)
FIG. 5, previously described, shows the respective states of the switches of the circuit of FIG. 2 in the example of operation of FIG. 4.

Phases IV and V are identically to those previously described in relation with FIGS. 4 and 5, except for the indifferent state of switch Td.

Finally, in the last and sixth (VI) phase (between times t6 and t7), the voltage of electrode 3 is brought to erasing level Ver by turning on switches Td and T5. Switch Tu is preferably off. Switches Ts and Ts' are off. Switches T22 and T22' are respectively off and on.

An advantage of this embodiment of the present invention is that it enables avoiding transistor T3, which is particularly bulky due to the strong currents that it must conventionally hold (likely to reach up to more than 100 amperes).

Another advantage of the present invention is that it requires no other structural modifications of the screen, only the control of transistors Tu and Td having to be adapted.

Figure 9:
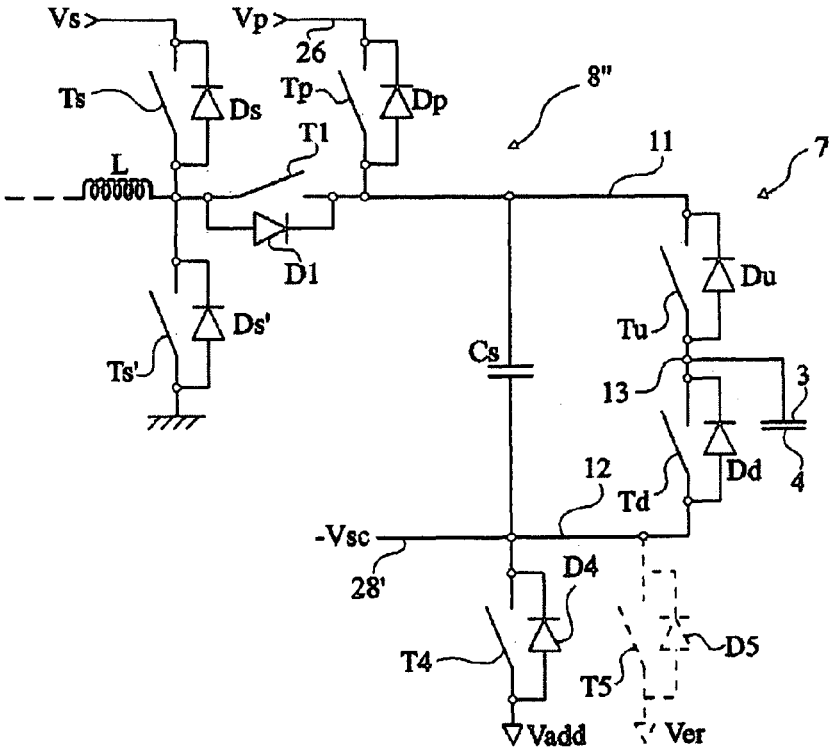
FIG. 9 shows a second embodiment of a control circuit according to the present invention.

FIG. 9 shows a second embodiment of a circuit 8" for controlling line addressing stages 7 according to the present invention.

According to this embodiment, capacitor Cs is connected between input terminals 11 and 12 of stages 7 and its biasing is ensured by a negative voltage —Vsc applied to terminal 12. As compared to the assembly of FIG. 6, transistor T6 and its diode D6 have been removed, and the rest of the assembly is identical and the control of the other switches is identical to that described in relation with FIGS. 7 and 8.

An advantage of this embodiment is that it removes an additional transistor (T6) from the circuit.

Figure 10:
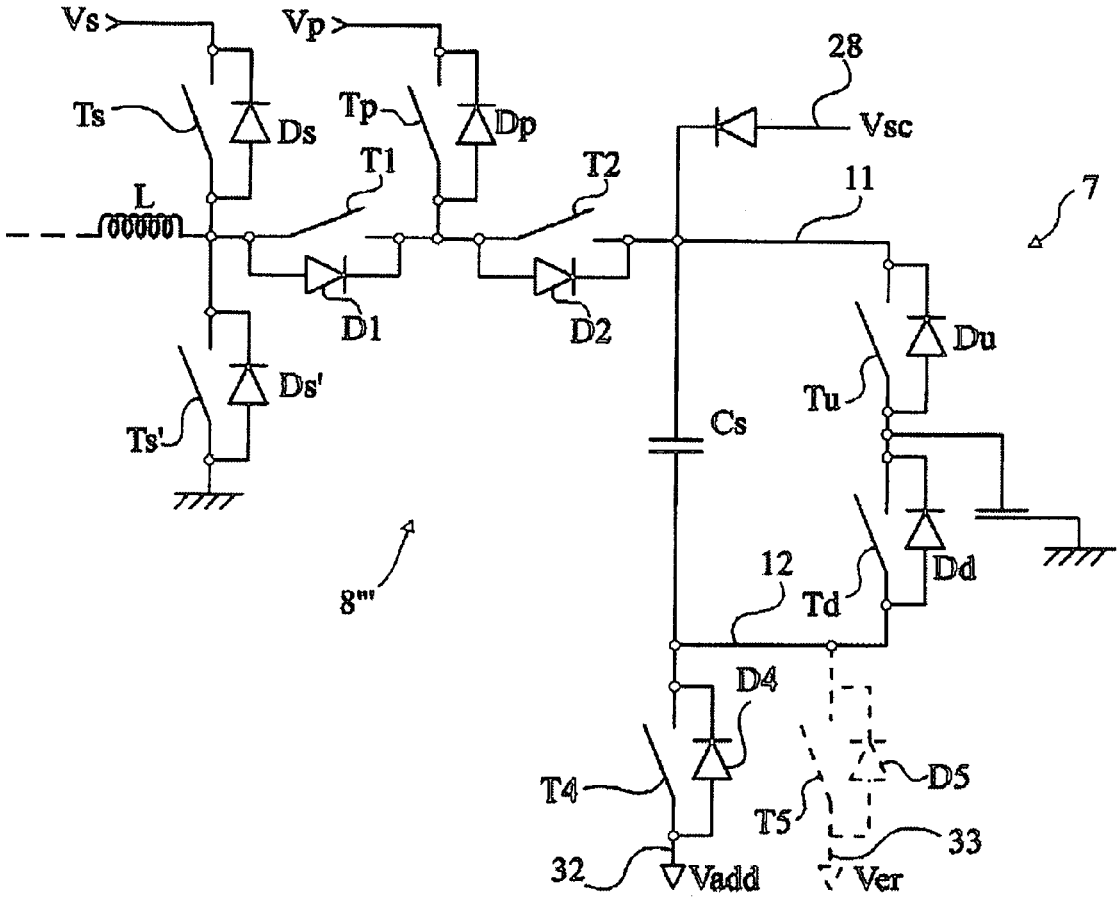
FIG. 10 shows a third embodiment of a control circuit according to the present invention.

FIG. 10 shows a circuit 8''' according to a third embodiment of the present invention.

As compared to the embodiment illustrated in FIG. 9, a switch T2 is added, in parallel with a diode D2, between the common node of switches Tp and T1 and terminal 11 corresponding to the electrode of capacitor Cs, the anode of diode D2 being connected to terminal 11. Its biasing is ensured by a diode Dsc connecting a terminal 78 of application of a voltage Vsc to terminal 11. This embodiment however is not a preferred embodiment due to the addition of transistor T2. Its function is to isolate stage 7 from the rest of the circuit during addressing and erasing phases IV and VI, switch Td being on during phase V.

Of course, the present invention is likely to have various alterations, modifications, and improvements that will occur to those skilled in the art. In particular, although the control signals of the different switches have been shown as being simultaneous to simplify the description, these signals may be slightly shifted in time to avoid possible problems of simultaneous conduction.

Further, adapting the circuit of generation of these control signals is within the abilities of those skilled in the art based on the functional indications given hereabove by using conventional tools.

Such alterations, modifications, and improvements are intended to be part of this disclosure and are intended to be within the spirit and the scope of the present invention. Accordingly, the foregoing description is by way of example only and is not intended to be limiting. The present invention is limited only as defined in the following claims and the equivalents thereto.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims and the equivalents thereof.

The invention claimed is:

1. A circuit for controlling at least one electrode of a plasma display panel having a plurality of electrodes, comprising:

one selection stage for each electrode, formed of two switches in series between first and second input terminals of the stage, respectively, and a junction point of the two switches connected to the electrode to be controlled; and at least one circuit for supplying power to the selection stage, the at least one circuit comprising:

a first stage of application of a first voltage to the first input terminal of the selection stage;

a second stage comprising an inductive element for supplying a current on said first input terminal; and and a control circuit coupled to the two switches in the selection stage, wherein the first switch of the selection stage is turned on at least for a phase of supply of said current to the electrode and the first switch is turned on for the application of the first voltage without directly coupling the first and second input terminals together.

2. The circuit of claim 1 wherein said second stage provides a second voltage smaller than the first, said first voltage switch of the selection stage being turned on for at least a subsequent phase of application of the second voltage.

3. The circuit of claim 2 wherein said power supply circuit comprises:

a first switch isolating the first and second stages from each other; and a capacitive element connectable between said first and second input terminals for the application of a third voltage, smaller than the second voltage.

4. The circuit of claim 3 wherein the power supply circuit comprises at least one third stage of application of a fourth voltage that is negative on the second input terminal of the selection stage, said first switch of the selection stage being turned off for periods of supply of the fourth voltage.

5. The circuit of claim 1 wherein no switch is provided in the circuit of the selection stage to directly connect said input terminals of the stage.

6. The circuit of claim 1 wherein said second stage provides a second positive voltage smaller than the first positive voltage, said first switch of the selection stage adapted to be turned on for at least a subsequent phase of application of the second voltage.

7. The circuit of claim 2 wherein said power supply circuit comprises:

a first switch isolating the first and second stages from each other; and a capacitive element connectable between said first and second input terminals for the application of a third voltage that is smaller than the second voltage.

8. The circuit of claim 3 wherein said capacitive element directly connects said input terminal of the selection stage, permanently, the third voltage being a negative voltage applicable on the second input terminal of the selection stage.

9. The circuit of claim 3 wherein the power supply circuit comprises at least one third stage of application of a fourth negative voltage on the second input terminal of the selection stage, said first switch of the selection stage adapted to be turned off during periods of supply of the fourth voltage.

10. The circuit of claim 3 wherein said capacitive element directly connects said input terminal of the selection stage, permanently, the third voltage being a negative voltage applicable on the second input terminal of the selection stage.

11. A plasma display panel, comprising:

at least one control circuit; and one selection stage for each electrode to be controlled, the selection stage coupled to the control circuit and comprising two switches in series between first and second input terminals of the stage, respectively, and a junction point of the two switches connected to the electrode to be controlled; and at least one circuit for supplying power to the selection stage, the at least one circuit comprising:

a first stage of application of a first positive voltage to the first input terminal of the selection stage; and a second stage comprising an inductive element for supplying a current on said first input terminal, wherein a first switch of the selection stage is turned on at least for a phase of supply of said current to the electrode without directly coupling the first and second input terminals together.

12. The panel of claim 11 wherein the first switch is turned on for the application of the first voltage.

13. A method for controlling current flow on an electrode of a display device, the electrode coupled to a node formed by a series connection of a first switch and a second switch, the first switch and the second switch coupled between a first input and a second input, respectively, the first input coupled to a first voltage potential and the second input coupled to a second voltage potential, the method comprising:

applying a precharge voltage from the first voltage potential to the electrode through the first switch without connecting the first and second inputs directly together; and applying a pulse train signal to the first node via the first switch without connecting the first and second inputs directly together.

14. The method of claim 13, comprising applying an erase voltage to the electrode through the second switch.

15. A circuit for controlling an electrode of a plasma display device, comprising:

first and second switches series connected between first and second inputs, respectively, to form an output node at the connection between the first and second switches, and having no switch directly connecting the first input terminal to the second input terminal;

a first voltage potential coupled to the first input, and a second voltage potential coupled to the second input; and a control circuit configured to coupled the first voltage potential to the electrode through the first switch without directly coupling the first and second input lines together.

16. The circuit of claim 15, further comprising a capacitor having a first terminal connected to the first input and a second terminal connected to the second input such that the capacitor is in parallel with the series-coupled first and second switches with respect to the first and second inputs.

17. A circuit for controlling an electrode of a plasma display device, comprising:

first and second switches series connected between first and second inputs, respectively, to form an output node at the connection between the first and second switches, and having no switch directly connecting the first input terminal to the second input terminal; and a first voltage potential coupled to the first input, and a second voltage potential coupled to the second input, wherein the first voltage potential comprises a scan voltage circuit directly coupled to the first input, and a precharge voltage circuit and a recovery circuit coupled to the first input line via a third switch.

18. The circuit of claim 17, further comprising a capacitor having a first terminal connected to the first input and a second terminal connected to the second input such that the capacitor is in parallel with the series-coupled first and second switches with respect to the first and second inputs.

* * * * *